United States Patent [19]

Darda

[11] 4,053,029

[45] Oct. 11, 1977

[54] SPRING DRIVE MECHANISM, PARTICULARLY FOR MOBILE TOYS

[76] Inventor: Helmut Darda, Im Tal, D-7712 Blumberg, Germany

[21] Appl. No.: 642,172

[22] Filed: Dec. 18, 1975

[30] Foreign Application Priority Data

| | | |
|---|---|---|
| Dec. 24, 1974 | Germany | 2461456 |
| Dec. 27, 1974 | Germany | 2461625 |

[51] Int. Cl.[2] ..... F03G 1/00

[52] U.S. Cl. ..... 185/39; 185/37; 185/DIG. 1

[58] Field of Search ..... 185/39, 37, 38, DIG. 1

[56] References Cited

U.S. PATENT DOCUMENTS

| | | | |
|---|---|---|---|
| 2,131,877 | 10/1938 | King | 185/DIG. 1 |
| 2,710,674 | 6/1955 | Duncan | 185/37 |
| 2,833,534 | 5/1958 | Foster | 185/37 |
| 3,375,904 | 4/1968 | Kaplan | 185/39 |

*Primary Examiner*—Samuel Scott
*Assistant Examiner*—Randall Heald
*Attorney, Agent, or Firm*—Haseltine, Lake & Waters

[57] ABSTRACT

A spring drive mechanism which is particularly suitable for mobile toys, for example, such as small toy autos. In a spring drive mechanism of the above-mentioned type, in that the axle of the reversing pinion is a portion of a spring wire which is retained in spring drive mechanism plates, whereby a spring portion which is located on the side of the elongate aperture is constructed as an abutment for displacing the axle of the reversing pinion to thereby form the drive connection. The inner hook-shaped constructed end of the drive spring engages behind a projection on the spring core shaft. When the spring is unloaded, this construction allows for the spring core shaft to further rotate, since the now stationary or more slowly rotating inner end of the spring will not hinder the further rotational movement of the spring core shaft.

18 Claims, 21 Drawing Figures

SPRING DRIVE MECHANISM, PARTICULARLY FOR MOBILE TOYS

FIELD OF THE INVENTION

The present invention relates to a spring drive mechanism which is particularly suitable for mobile toys, for example, such as small toy autos.

DISCUSSION OF THE PRIOR ART

The present invention emanates from a spring drive mechanism which includes a drive spring whose ends are presently connected with gear wheels located on an axle so that the spring can be wound up from both ends thereof and is again able to deliver the stored force from both its ends. The gear wheels which are connected with the spring ends, being a part of a differential drive becoming effective during spring wind-down, have different diameters. Located in parallel to the spring core shaft is the drive shaft, the latter of which concurrently serves as a wind-up shaft.

Rotatably arranged on the shaft are two pinions of different diameters, of which the smaller one is in engagement with the larger spring gear wheel and the larger with the smaller spring gear wheel. These pinions are in rotational connection with the drive shaft presently in only one rotational direction through the intermediary of directional escapements having opposite directional effects. The directional escapements effect that basically, upon rotation of the drive shaft in one direction, only one pinion will transmit the torque, whereas upon rotation of the drive shaft in the other direction the other pinion will transmit the torque. The presently remaining pinion runs along idly due to the directional escapement arrangement. Provided axially parallel to the spring and pinion, or respectively drive shaft, is a so-called reversing pinion which possesses two gear tooth rims. One of the gear tooth rims is constantly in engagement with a spring gear tooth whereas, for spring wind-up, the other pinion tooth rim is adapted to be placed into driving engagement with the pinion which is not in engagement with the first spring gear wheel. This reversing pinion has the effect that, upon rotation of the spring gear wheel in one rotational direction, the other spring gear wheel is concurrently rotated in the opposite direction, meaning, that the rotational movement which becomes effective on the one spring gear wheel is reversed for the other spring gear wheel. In that type of arrangement, during spring wind-up, the drive spring is thus tensioned from both ends thereof.

For manufacture a construction is suitable in which one of the two supports for the reversing pinion must be constructed as an elongated aperture so that, under the effect of a spring, the gear rim which is associated with this elongate aperture-like support is maintained out of engagement through the action of a spring, and can be brought into engagement only for purposes of winding up through a one-sided pressing down of the reversing pinion shaft.

SUMMARY OF THE INVENTION

Accordingly, it is an object of the present invention to so simplify a construction of the above-mentioned type, to thereby eliminate a number of individual components and reduce the costs thereof.

The foregoing object is attained in a spring drive mechanism of the above-mentioned type, in that the axle of the reversing pinion is a portion of a spring wire which is retained in spring drive mechanism plates mechanism plates, whereby a spring portion which is located on the side of the elongate aperture is constructed as an abutment for displacing the axle of the reversing pinion to thereby form the drive connection.

Already in this construction, the known return spring assumes presently three functions, namely:

1. It carries the reversing pinion;
2. It maintains the reversing pinion in a disengaged position, or respectively leads it back into the initial position after the removal of the load; and
3. It forms an abutment which has an effect, for example, on an actuating projection provided on the vehicle or toy automobile body for deflection of the axle.

In order that the spring driven mobile toy after the winding down of the spring still possesses a free-running capability, the connection between the spring and the drive shaft must be detachable.

In a known manner, the foregoing can be achieved in that the inner hook-shaped constructed end of the drive spring engages behind a projection on the spring core shaft. When the spring is unloaded, this construction allows for the spring core shaft to further rotate, since the now stationary or more slowly rotating inner end of the spring will not hinder the further rotational movement of the spring core shaft.

In order to avoid a spring fracture, in particular due to excessive winding up of the spring, it is suitable that the external end of the spring also be detachably connected with the spring housing. For this purpose, for example, there is suitable a sliding brake which, under spring pressure, lies against the inner annular surface of the spring housing drum.

Notwithstanding these protective measures, in particular for weaker dimensioned springs which can be utilized for the drive of miniaturized toy autos, spring fractures are already encountered after even a relatively low number of spring wind-ups.

Preferably these fractures are encountered at the inner spring end after the first spring wind-up.

Such spring fractures can be largely avoided when the inner spring end includes a tongue which is narrowed at least with respect to the spring width, whose unwinding length is smaller than the outer circumference of the spring core shaft and whose end is bent into a spring hook, whereby the cylindrical spring core shaft possesses a recess of slot for receiving the spring hook, to which there is connected an annular groove extending in the spring wind-up direction, whose width corresponds to the tongue width and whose depth in the region of the recess to the spring hook length.

This construction of the spring end and spring core, on the one hand, has the effect that the spring is wound almost cylindrically and, on the other hand, through the guidance and retention of the spring tongue in the spring core groove prevents the spring from extensively displacing in an axial direction so that the spring housing cover would be pressed away and the spring could jump out of the spring housing.

An exact circular winding cross-section and an improved guidance, is however, obtained only when, pursuant to a further proposal of the present invention, there is additionally provided an annular groove which extends opposite to the spring wind-up direction and is connected to the recess for receiving of the inner spring hook, and which receives the spring tongue or tongues at a wound-up spring.

In this spring housing construction any bending kink is avoided during the winding up of the spring. In the unstressed condition, the groove prevents the disruptive axial displacement of the spring which could lead to a snapping open of the spring housing.

BRIEF DESCRIPTION OF THE DRAWINGS

Reference may now be had to the following detailed description of exemplary embodiments of the invention, taken in conjunction with the accompanying drawings; in which.

DETAILED DESCRIPTION

Figure 1:
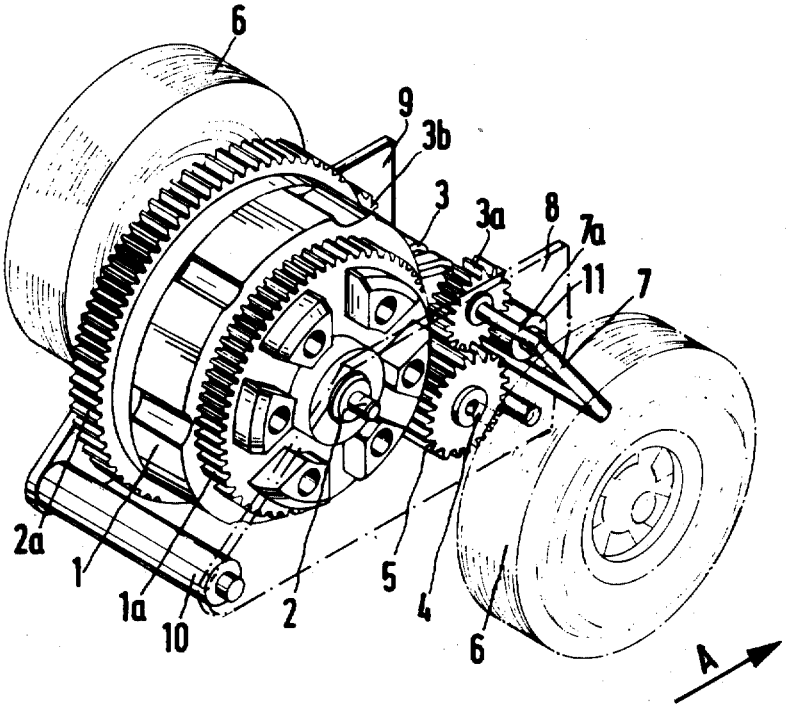
FIG. 1 is a perspective representation of the inventive spring drive mechanism with drive wheels.
Figure 2:
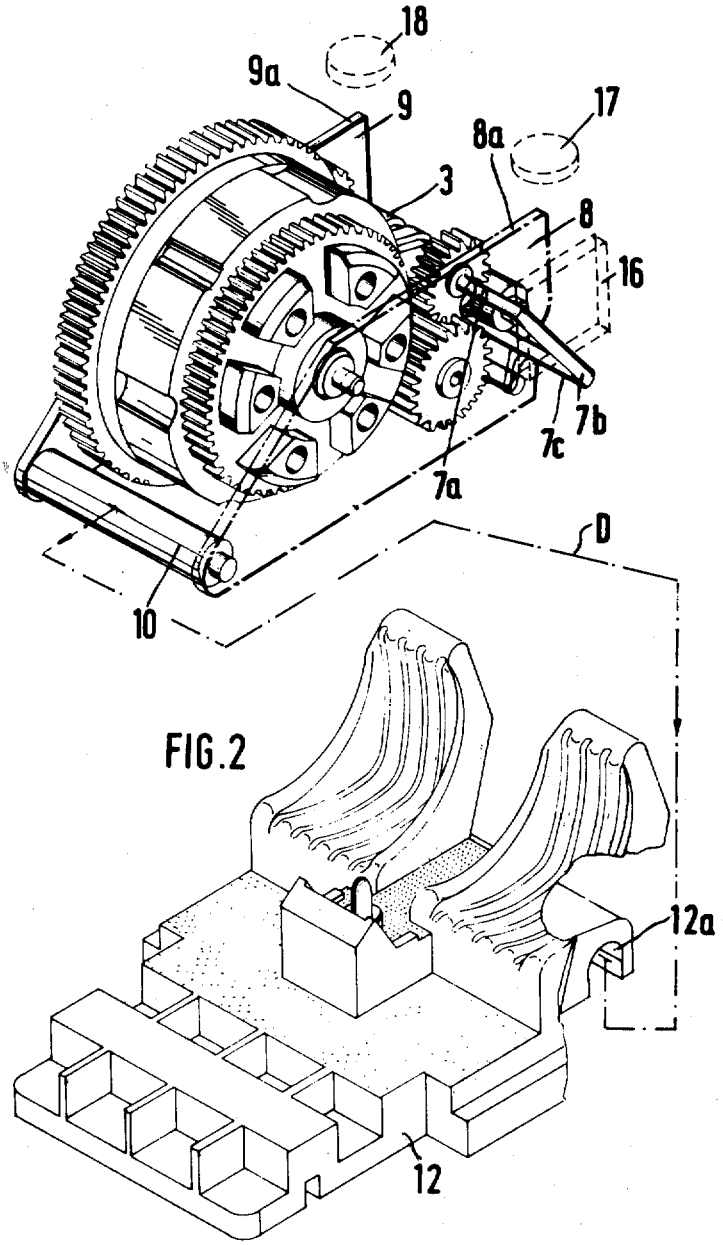
FIG. 2 shows a perspective representation of the inventive spring drive mechanism with a schematically illustrated automobile body portions of a toy auto not otherwise shown.

Illustrated in FIGS. 1 and 2 of the drawings is an inventively constructed spring drive mechanism which may be utilized, for example, in a toy auto.

The drive mechanism is arranged so as to be pivotable within limits so that, as described in greater detail hereinbelow, the wheel mechanism may be conducted from a position in which the drive wheels are driven from the unloading or unwinding spring, into such a position in which the drive spring is wound up through rotation of the drive wheels in both rotational directions.

The drive spring, which is not illustrated in this Figure of the drawing, is located in a spring housing 1 which is provided with a first spring gear wheel 1*a*. The second spring gear wheel 2*a* is connected with the spring core shaft 2. The inner end of the drive spring is in connection with the spring core shaft 2, the outer end in contrast thereto with the spring housing 1.

Standing in engagement with the gear wheels 1*a* and 2*a* are pinion gear tooth rims which are arranged on the drive shaft 4, of which only the gear tooth rim 5 is ascertainable in the drawing. Arranged between the pinion gear tooth rim 5 and the pinion shaft 4 are directional escapements, not presently shown in detail, having opposite directional effects, which provide the effect that the torques which are produced on the drive shaft 4 are transmissible either to the spring gear wheel 1*a* or to the spring gear wheel 2*a* in accordance with the rotational direction. This construction thus has the result that the spring is constantly stressed independently of the direction of rotation of the pinion shaft 4.

Mounted on the pinion shaft 4 are the vehicle or automobile wheels 6.

Furthermore, there is illustrated the reversing pinion 3 whose only partially shown pinion gear tooth rim 3*b* is constantly in engagement with the spring gear wheel 2*a*, whereas the second pinion gear rim 3*a* is disengaged in the positions shown in FIGS. 1 and 2. Upon pressing down on its axle 7*a*, it comes into operative connection with the pinion 5. Thereby is provided the position in which the drive spring can be wound up through rotation of the wheels 6 in both directions. When, for example, the wheels 6 are rotated in a clockwise direction, then the vehicle with a depressed shaft 7*a* is thus displaced in the direction of the arrow A, and the pinion 5, thanks to the mentioned directional escapement, drives the drive gear wheel 1*a* in the counterclockwise direction.

By means of this gear wheel, the drive spring, which is not shown, is stressed commencing from its outer end. The rotational movement of the pinion 5 is, however, also concurrently transmitted through the reversing pinion 3, whose first gear tooth rim 3*a* is in engagement with the pinion 5 and whose second gear tooth rim 3*b* with the second spring gear wheel 2*a* for reversedly tran smitting to the latter whereby the spring is concurrently also stressed from its inner end. Upon rotation of the wheels 6 in the counterclockwise direction, in effect, displacement of the drive mechanism opposite to the direction of arrow A, the pinion which is not shown in the drawing on the drive shaft 4 becomes effective, whereas the pinion 5 idles along, so that reversed functions are encountered and, similarly, the spring gear wheels 1*a* and 2*a* rotate in the same rotational directions, as previously mentioned.

The collective shafts of the spring drive mechanism are arranged between the two plates 8 and 9, the latter of which are connected with each other by means of the two pillars or posts 10 and 11.

As is schematically indicated in FIG. 2, by means of the unitary bearing or seating group 12, which at its rear side possesses a downwardly opening pivot bearing 12*a* which encompasses the post 10 of the spring drive mechanism, the spring drive mechanism is retained at a limited pivotal displacement within the not shown vehicle auto body. Indicated through the phantom line D is the manner in which the drive mechanism is suspended in the bearing group.

For the displacement of the reversing pinion 3 there is provided on the auto body (not shown) an actuating projection 16 which, upon depression of the auto body, exerts an effect on the spring arm 7*c*, which leads the pinion shaft 7*a* downwardly through intermediary of the connecting yoke 7*b*. In order to prevent an excessive loading of the gear mechanism, which is particularly sensitive for smaller drive mechanisms, contact surfaces 17 and 18 are provided on the auto body, against which there locate the upper edges 8*a* and 9*a* of the plates 8 and 9 serving as contacts or stops for limiting the pivotal path.

Figure 3A:
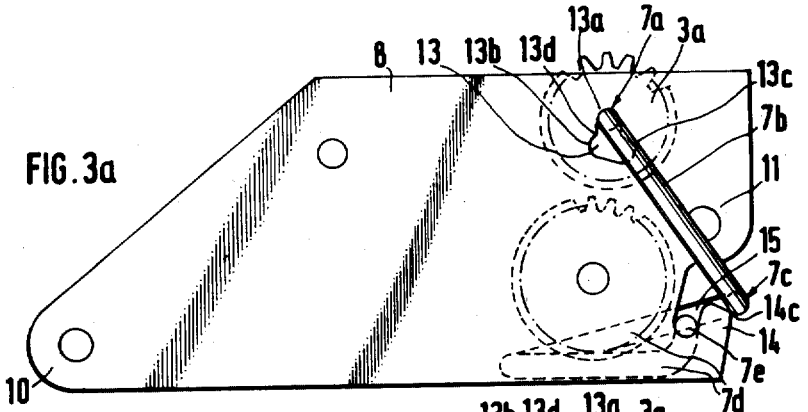
FIG. 3 shows a side elevational view of the inventive spring drive mechanism, with the spring housing and spring gear wheels removed, with schematically indicated drive pinions and reversing pinions in threee different operative positions, namely FIG. 3*a* being the position at spring wind-down and at-rest position.
FIG. 3*b* at spring wind-up and rotation of the drive shaft in a counterclockwise direction.
FIG. 3*c* at spring wind-up and rotation of the drive shaft in a clockwise direction.
Figure 3B:
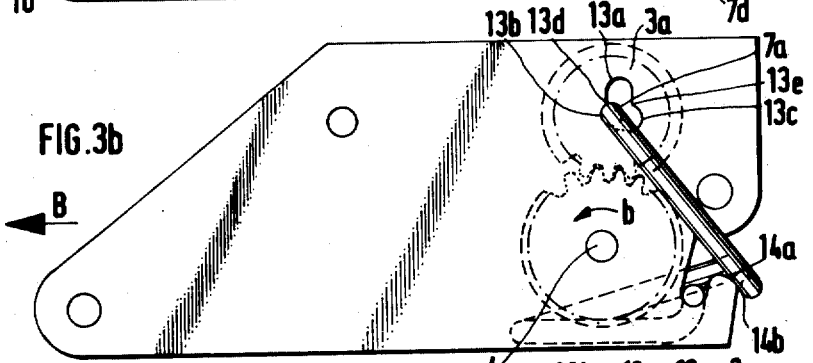
Figure 3C:
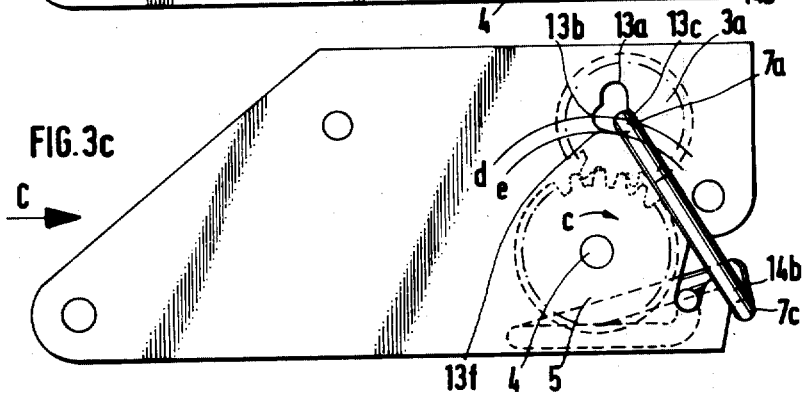
Figure 4:
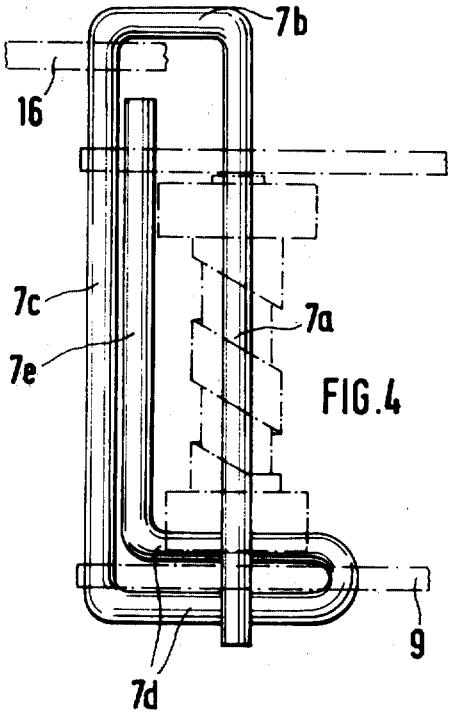
FIG. 4 illustrates a plan view of the spring serving concurrently as reversing pinion shaft including schematically illustrated auto body components and reversing pinion.
Figure 5:
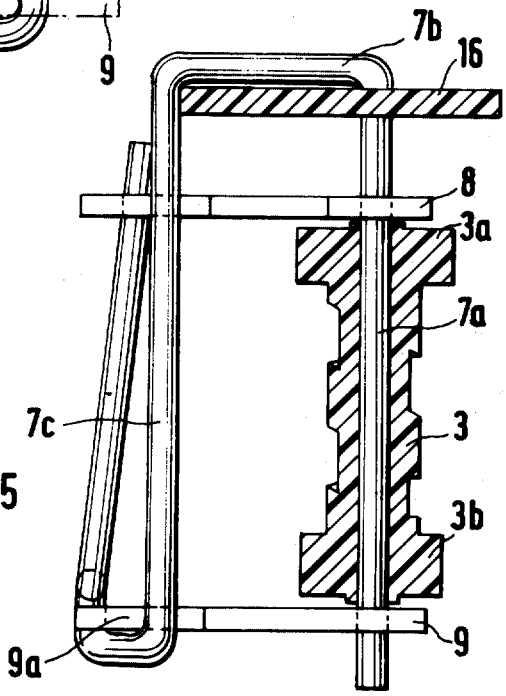
FIG. 5 shows a plan view of the arrangement of FIG. 4 from the left side thereof with sectionally illustrated reversing pinion and sectionally shown actuating projection of the not illustrated auto body.

A core element of the present invention, namely the element 7, is shown in detail in FIGS. 3 through 5. This constructional element presently concurrently forms the shaft 7*a* for the reversing pinion 3, forms with its connecting yoke 7*b* a support for the actuating projection 16, and produces by means of the sections 7*c*, 7*d* and 7*e* the return force for the pinion shaft 7*a*, whereby the fastening of this element is additionally carried out in a simple manner through suspension of the spring winding 7*d*, or respectively the outer end of the arm 7*e*, in a corresponding catches, or respectively recesses in the plates 8 and 9.

The free end of the pinion shaft 7*a* is introduced in a bore in the plate 9 which corresponds to the cross-section of the shaft. The opposite located end, in contrast therewith as shown above all in FIGS. 3*a* through 3*c*, passes through a kind of bearing in the plate 8 formed by an elongate aperture 13 having additional recesses 13*b* and 13*c*. At this end, the spring arm 7*a* serving as the pinion shaft is connected through the arm 7*b* extending in parallel to the plate 8 with an arm 7*c* extending in parallel with the arm 7*a*, the former of which is located on a plate extension 14 of the plate 8. Connected to the end of the spring arm 7*c* which is located on the side of the plate 9 is an elongate constructed spring winding 7*d* which encompasses a projection formed on the bottom surface of the plate 9. As may be ascertained from FIG. 4, this winding extends in perpendicular to the direction within which the spring arm 7*c* and the pinion shaft 7*a* can be deflected by means of the actuating projection 16.

The spring winding 7*d* extends into a third arm 7*e* which, similarly, extends in parallel with the arms 7*a* and 7*c*, and which is resiliently suspended with the free end thereof in a recess 15 formed behind the plate extension 14. In this arrangement, the spring arms 7*c* and 7*e*, as well as the spring winding 7*d*, produce the required return force for the return of the pinion 3, whereby the spring properties of the connecting yoke 7*b* can also be utilized.

This construction of the return spring has the great advantage that, notwithstanding the relatively large diameter required for the pinion shaft 7*a*, there is produced a flat or uniform spring constant.

Moreover, the spring element 7 is in itself so shaped that, without the aid of specialized fastening elements, it can be suspended in the plates of the mechanism under its own tension.

It is extremely important to the operative safety of a switchable drive that the gear wheel which is to be switched over, in present instance the gear tooth rim 3*a* of the reversing pinion 3, may be moved rapidly, and for the user safely, from one switch position into the other through the overcoming of a pressurepoint. Thus should be avoided that the gear tooth tips of the pinion gear tooth rim 3*a* be initially in engagement with only the gear tooth tips of the pinion 5. As a result this would have, on the one hand, the excessive loading of the gear wheels which would lead to rapid wear or even fracture. On the other hand, with only a loose tooth engagement there is provided the danger that the gear wheels will rotate or slide through with respect to each other so as to provide a chattering noise. The spring which is located in the spring housing 1, which is located with a sliding brake against the ridged inner wall of the spring housing, causes a similar noise in the stressed condition at further winding, if the user erroneously has the impression that the spring has already been tensioned.

In order to avoid these disadvantages, control linkages are provided for the control of the pinion shaft 7*a* which effect that, upon pressing down on the vehicle body acting on the pinion shaft, a predetermined pressure point is to be overcome before the pinion gear tooth rim 3*a* comes into engagement with the pinion 5, so as to afford a rapid switching sequence without any slow transition.

For this reason, the resilient arm 7*c* which is connected with the pinion shaft 7*a* through the spring yoke 7*b*, on the one hand, is located on an incline 14*a* of the plate extension and can be brought into contact with the rear locking surface 14*b* only upon overcoming the projection 14*c*.

Additionally hereby, the pinion shaft 7*a*, upon overcoming the locking projection 13*d*, or respectively 13*e*, comes out of upper notch or cutout 13*a* of the elongateliked apertured support 13, into either the front notch 13*b* or the rear notch 13*c*. Upon movement of the drive mechanism which is located, for example, in a toy automobile, in the direction of the arrow B, meaning thereby the rotation of the pinion shaft 4 in a counterclockwise direction *b*, the pinion shaft 7*a* is forced into the front notch 13*b* (compare FIG. 3*b*).

Upon displacement of a spring drive mechanism, which is built into a toy auto, in the direction of the arrow C, in which the pinion shaft 4 is rotated by means of the drive wheels (not shown) in a clockwise direction as shown by arrow C, the pinion shaft 7*a* is conveyed into the notch 13*c* which is located somewhat lower with respect to the notch 13*b*. In order that during this switching sequence the gear tooth rim 3*a* does not disengage from the pinion 5, care must be exercised that the pinion shaft 7*a* moves along an arc *d* which is concentric with respect to the middle point of the pinion 5. So as to achieve the foregoing, the connecting surface 13*f* between the notches 13*b* and 13*c* concurrently assumes an arcuate segment about an arc *e* which is concentric to the middle point of the pinion 5 (compare FIG. 3*c*).

Since during the transition from the notch 13*b* into the notch 13*c*, as previously, the actuating projection 16 pursuant to FIG. 2 lies on the arm 7*c*, this will prevent the pinion shaft 7*a* from moving into the upper notch 13a wherein the driving interconnection between the pinion gear tooth rim 3 and pinion 5 would be interrupted.

The mutually oppositely located notches 13b and 13c thus effect, in conjunction with the locking surface 14b and the actuating projection 16 which exerts a load on the arm 7c, that the pinion gear tooth rim 3a remains in assured tooth engagement notwithstanding the changing load conditions.

Illustrated in FIGS. 7 through 13 are the construction and arrangement of the drive spring 25 which is located within the spring housing 1.

Figure 6:
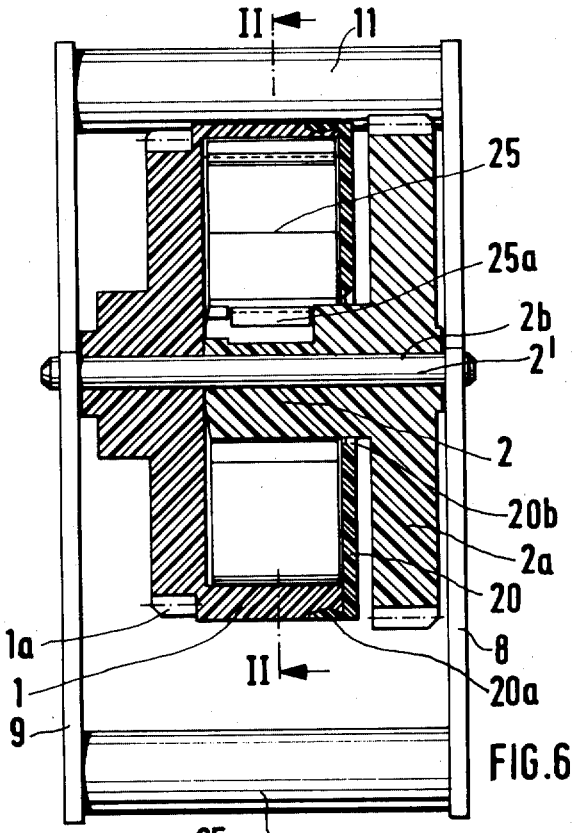
FIG. 6 is an axial section through the inventive spring housing pursuant to the first embodiment.
Figure 7:
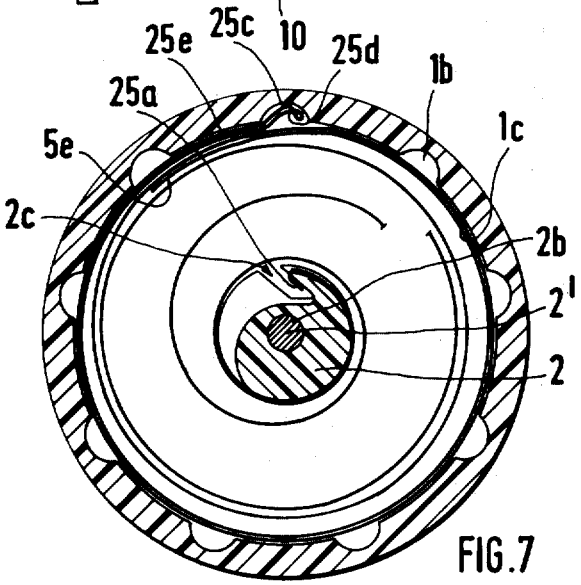
FIG. 7 is a radial section taken along line II—II in FIG. 6.

As is indicated in FIGS. 6 and 7, the spring housing consists of a spring housing drum 1 with a sprayed-on spring gear wheel 1a, and a spring housing cover 20 which closes off the interior of the spring housing drum. The spring housing cover is provided with a collar-like rim 20a which extends in an axial direction and engages in a complimentary shaped annular groove in proximity to the open side of the spring housing drum 1 so as to absorb radially acting spring forces.

In order to be able to also take up forces acting in an axial direction on the cover, the rim is provided with a radially inwardly projecting extension or bead, which engages in a complimentary contraction in the groove provided on the spring housing drum.

Suitably, the diameter of the spring housing 20 corresponds with the rim 20a of the outer diameter of the spring housing drum 1, so that the spring housing 1 drum together with the cover mounted thereon form a closed cylindrical disc.

Located centrally in the interior of the spring housing drum is the spring core shaft 2, which preferably similarly consists essentially of plastic material, and onto which there may be directly sprayed or coated the second spring gear wheel 2a. The spring core shaft with the spring gear wheel 2a is located on an axle 2b which preferably is formed of steel and which, for example, may be rigidly connected with the spring housing 1 or with the plates 8 and 9 between which it is supported. The pltes 8 and 9 are, in a known manner, interconnected by posts 10 and 11.

Positioned between the spring housing drum 1 and the spring core shaft 2 is the spirally constructed drive spring 25.

As may, above all, be recognized from FIG. 7, the inner end of the spring is bent into a hook 25a, which is hooked into a recess 2c in the spring core shaft 2. The recess 2c terminates at the forward free end of the spring core shaft 2, so that the hook can be suspended in a simple manner throught the axial together movement of the spring and spring core shaft.

Further details may now be ascertained with respect to FIGS. 8 through 13.

The outer spring end, which resiliently lies against the inner annular surface 1c of the spring housing drum 1, is formed as a slide brake. For this purpose there is provided with the radially outwardly directed bends 25c and 25d which, for an increase in the resistance moment, engage in corresponding grooves 1b provided on the drum inner surface 1c. The inwardly located section 25d of the bend extends into a further spring winding 25e which, as is shown in FIG. 7, is longer than the circumference of the inner drum surface 1c. Thereby, the section 25e together with the somewhat contacting spring windings, produces a radially outwardly directed force by means of which the bent ends 25c, 25d are pressed in the recesses. Due to this simple measure, there may thus be eliminated the heretofore usual drag spring, which had to be applied to the outer spring end or riveted thereto.

Decisive for an increase in the life span of the spring is, however, the construction of the inner spring end, as well as the spring core shaft.

In accordance with an important aspect of the present invention, the inner spring end 25, or respectively 25', extends in a tongue shape, whereby either one tongue 25b (compare FIG. 10), or respectively a plurality, preferably two, tongues 25b' (compare FIG. 13) are arranged adjacent each other.

At the ends of these tongues 25b, respectively 25b', there are arranged the spring hooks 25a, respectively 25a'.

These tongues have the grooves 2d and 2e, respectively 2d' and 2e', in the spring core shaft 2, respectively 2', associated therewith. The spring hooks 25a, respectively 25a', slide into the grooves 2d, respectively 2d' when, after wind-down of the spring, the spring end remains stationary and the spring core shaft 2, respectively 2', continues to rotate idly. The gradual increase in the groove radius until up to the radius of the core shaft has the effect that the spring hook detaches from the spring core shaft without any appreciable resistance moment.

Figure 8A:
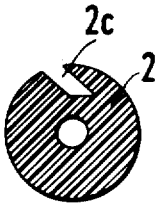
FIG. 8*a* is a radial section taken along line III*a*—III*a* in FIG. 8.
Figure 8B:
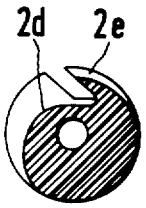
FIG. 8*b* is a radial section taken along line III*b*—III*b* in FIG. 8.
Figure 8C:
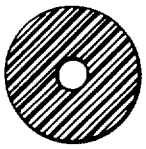
FIG. 8*c* is a radial section taken along line III*c*—III*c* in FIG. 8.
Figure 8:
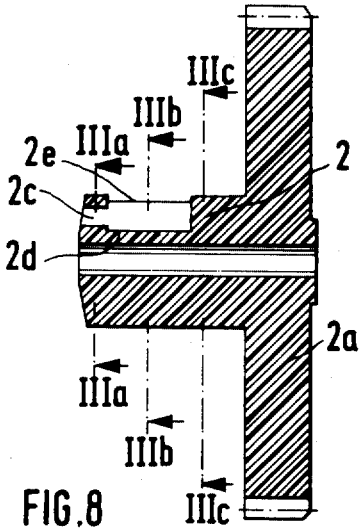
FIG. 8 is an axial section through the spring core shaft with a sprayed-on spring gear wheel pursuant to the embodiment of FIGS. 6 and 7.

On the other hand, the connectors which located between the grooves, visible in FIGS. 8a and 8c, form in conjunction with the spring core shaft 2, respectively 2', a cylindrical winding mandrel on which the spring winds in the form of an exact spiral during spring wind-up.

Figure 9A:
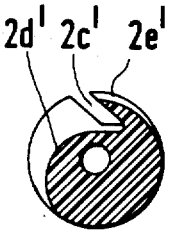
FIG. 9*a* is a radial section taken along line IV*a*—IV*a* in FIG. 9.
Figure 9B:
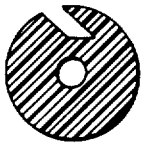
FIG. 9*b* is a radial taken along line IV*b*—IV*b* in FIG. 9.
Figure 9C:
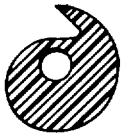
FIG. 9*c* is a radial section taken along line IV*c*—IV*c* in FIG. 9.

In the usual construction of spring core shafts, which corresponds to the sections in FIGS. 8b and 9a, the spring is contrastingly wound up in an oval form, which will lead rapidly to spring fracture due to the non-uniform demands thereon.

The groove 2e serves the same purpose which, pursuant to the drawing, connects to the recess 2c in a clockwise direction. Located in this groove 2e, whose maximum depth corresponds to the spring thickness and which similarly gradually extends into the core shaft surface, at spring wind-up the inner spring end positions itself therein so that there is formed in this region a winding body of cylindrical form on which the spring windings wind up at the lowest possible demand. Also through this measure is there considerably increased the life span of the spring.

Figure 9:
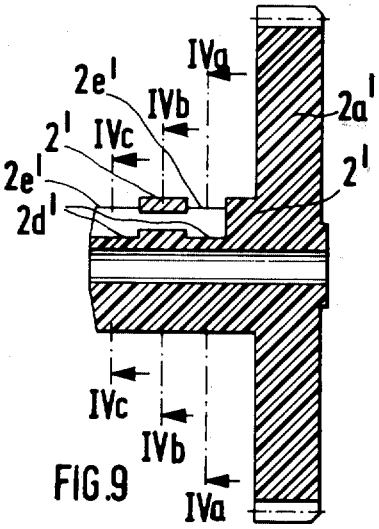
FIG. 9 is an axial section through a spring core shaft corresponding to the embodiment of FIG. 8 with sprayed-on gear wheel.
Figure 11:
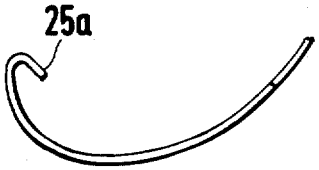
FIG. 11 is a side elevational view of the spring end pursuant to FIG. 10.
Figure 10:
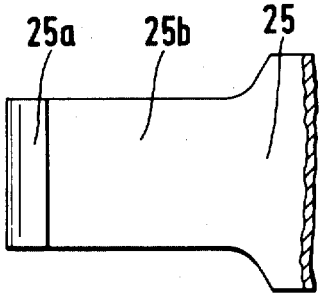
FIG. 10 is an enlarged plan view of the spring end of the spring utilized in the embodiment according to FIGS. 6 through 8.
Figure 12:
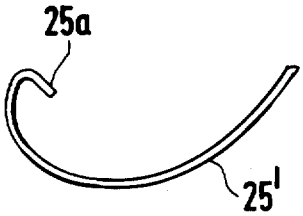
FIG. 12 is an enlarged view of a spring end adapted for the spring core shaft pursuant to FIG. 9.
Figure 13:
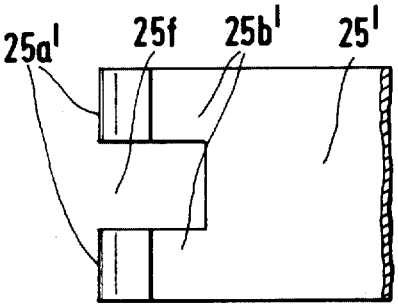
FIG. 13 is a side elevational view of the spring end of FIG. 12.

In the utilization of a spring having a spring end pursuant to FIG. 13 there are suitably provided two grooves 2e, as is indicated in accordance with the FIGS. 9.

While there has been shown what is considered to be the preferred embodiment of the invention, it will be obvious that modifications may be made which come within the scope of the disclosure of the specification.

What is claimed is:

1. In a spring drive mechanism, particularly for toy vehicles; a drive spring; a plurality of gear wheels of different diameters being arranged on an axle, said drive spring having the ends thereof connected to said gear wheels; a drive and spring wind-up shaft located in parallel with said axle; two pinions having different diameters being located on said shaft; directional escapement means having oppositely effective rotational directions adapted to interconnect said pinions with said gear wheels, the smaller diameter pinion being in engagement with the spring gear wheel having the larger diameter and the larger diameter pinion being in engagement with the spring gear wheel having the smaller diameter; a reversing pinion having two gear tooth rims, one said gear tooth rim being in constant engagement with the first of said pinions, the other said gear tooth rim adapted to be brought into operative connection with the spring gear wheel which is not in engagement with said first pinion; spring drive mechanism plates for supporting the axle of said reversing pinion; a bearing support formed as an elongate aperture for producing the drive connection; and a spring being acted upon by the portion of the axle of said reversing pinion for disengagement of the drive connection, the improvement comprising: said reversing pinion axle being a portion of a spring wire retained in said plates, a part of said spring wire located on the side of said elongate aperture being a support member for effecting displacement of the reversing pinion axle so as to provide said drive connection.

2. A mechanism as claimed in claim 1, said spring wire being bent into a U-shape, one arm of said U-shape rotatably supporting said reversing pinion, the other arm being a spring arm, said plate being fastened to the open side of said U-shape, and an arm portion located proximate the connecting yoke of said two arms forming the support member for an actuating projection serving for the one-sided deflection of said reversing pinion.

3. A mechanism as claimed in claim 2, the free end of the U-shape formed spring arm being bent over so as to encompass and respectively pass through a portion of said plate; and a third arm extending generally parallel to said U-shaped arms being supported under its own tension with said free end against the oppositely located mechanism plate.

4. A mechanism as claimed in claim 3, said spring wire portion passing through said plate forming a winding extending generally perpendicular to the direction in which said spring arm is displaceable.

5. A mechanism as claimed in claim 4, said winding being elongate and having portions extending parallel to said plate and encompassing a projection on said plate.

6. A mechanism as claimed in claim 2, said elongate bearing support for said reversing pinion axle including two mutually oppositely located locking apertures in which the depressed axle is adapted to selectively engage in conformance with the direction of rotation of said drive and wind-up shaft; and a plate extension having an incline, a locking surface and an interposed projection being arranged proximate said support member for the actuating projection for effecting movement control.

7. A mechanism as claimed in claim 6, said locking apertures having a connecting surface therebetween extending on an arc concentric with said drive and wind-up shaft.

8. A mechanism as claimed in claim 6, comprising a recess being formed behind said plate extension for receiving the free end of said third spring arm.

9. A mechanism as claimed in claim 8, said recess narrowing above the inserted spring arm.

10. A mechanism as claimed in claim 1, including a toy auto body receiving said mechanism for limited pivotal movement therein, said actuating projection being located in the region of the pivotable pinion shaft; a post connecting said mechanism plates forming the pivot axis and being rotatably supported in a bearing group forming a component of the vehicle.

11. A mechanism as claimed in claim 10, said bearing group including on the side thereof facisng towards the mechanism a downwardly opening bearing encompassing the connecting post from upwardly thereof and depressable against the vehicle floor.

12. A mechanism as claimed in claim 10, said mechanism plates including contacts on their surfaces adapted to contact stops in said vehicle auto body for limiting the pivotal movement of said drive mechanism.

13. A mechanism as claimed in claim 12, comprising a drive spring having an inner end connected with said spring core shaft, said end having at least one tongue narrower than said spring width, whose winding down length is lesser than the outer circumference of said spring core shaft and the end of which is bent into a spring hook; a recess being formed in said cylindrical spring core shaft for receiving said spring hook; an annular groove extending in the spring wind-up direction communicating with said recess, having a width corresponding to that of said tongue and a depth in the region of said recess to that of the spring hook length; a spring housing having the outer end of said drive spring detactably connected thereto; a second annular groove extending opposite to the direction of spring wind-up communicating with said recess, whose width corresponds to that of said tongue and the depth to that of the spring thickness and which constantly extends into the circumferential surface of said spring core shaft.

14. A mechanism as claimed in claim 13, said second annular groove having a length as measured in the circumferential direction of between $\frac{1}{4}$ to $\frac{3}{4}$ the circumference of said spring core shaft.

15. A mechanism as claimed in claim 13, said recess terminating at one end surface of said spring core shaft for receiving said spring hook.

16. A mechanism as claimed in claim 13, comprising a spring housing drum; a cover for closing said drum, said cover including a collar-like rim encompassing said drum exteriorly thereof.

17. A mechanism as claimed in claim 16, said cover and said drum having equal external diameters, said cover rim having an inwardly extending projection, and said drum having an annular groove for receiving said rim.

18. A mechanism as claimed in claim 13, said spring housing drum and said spring core shaft being each integrally connected with a gear wheel, and being constructed of plastic material.

* * * * *